United States Patent [19]

Verry

[11] Patent Number: 5,012,544

[45] Date of Patent: May 7, 1991

[54] MULTIPURPOSE BATHING WIPER CONSTRUCTION

[76] Inventor: George H. Verry, 179 Monroe St., Pembroke, Mass. 02359

[21] Appl. No.: 413,247

[22] Filed: Sep. 27, 1989

[51] Int. Cl.[5] ..... A47K 7/04

[52] U.S. Cl. ..... 15/209 R; 15/228; 15/231

[58] Field of Search ..... 15/209 R, 210 R, 228, 15/231, 232, 244.1, 244.2, 220 R

[56] References Cited

U.S. PATENT DOCUMENTS

| | | | |
|---|---|---|---|
| 565,408 | 8/1896 | Foley | 15/244.1 |
| 866,897 | 9/1907 | Willey | 15/232 |
| 869,842 | 10/1907 | Hill | 15/231 |
| 1,287,628 | 12/1918 | Brown | 15/231 |
| 2,124,220 | 7/1938 | Winston | 15/231 |
| 2,537,784 | 1/1951 | Nord | 15/209 R |
| 3,261,049 | 7/1966 | Murphy | 15/231 |
| 4,685,167 | 8/1987 | Murray | 15/228 |
| 4,845,800 | 7/1989 | Pederson et al. | 15/228 |

FOREIGN PATENT DOCUMENTS

| | | | |
|---|---|---|---|
| 1384671 | 11/1964 | France | 15/228 |
| 15687 | 4/1906 | Norway | 15/232 |
| 112773 | 11/1925 | Switzerland | 15/231 |
| 5580 | of 1900 | United Kingdom | 15/232 |
| 5768 | of 1901 | United Kingdom | 15/231 |
| 392244 | 5/1933 | United Kingdom | 15/231 |

*Primary Examiner*—Philip R. Coe
*Assistant Examiner*—Mark Spisich
*Attorney, Agent, or Firm*—Paul J. Cook

[57] ABSTRACT

A wiper construction is provided which includes a plate, a handle secured to a central portion of the plate and two straps secured to each end portion of the plate which are adapted to secure a sheet-like washing material to the plate.

3 Claims, 1 Drawing Sheet

MULTIPURPOSE BATHING WIPER CONSTRUCTION

BACKGROUND OF THE INVENTION

This invention relates to a multipurpose wiper construction such as a bathing wiper which permits washing of parts of the body which can not be either reached by the hand or must be reached by bending. More specifically, the present invention provides a bathing wiper construction which permits washing of all parts of the body without bending and which utilizes conventional cleaning means which can be subsequently sanitized.

At the present time, there are a wide variety of washing devices used for bathing the body including those disclosed in U.S. Pat. Nos. 1,730,299; 4,1047,259; 4,336,623 and 4,615,066, all of which require a washing means such as a sponge or a cloth of specific design unique to the bathing wiper construction disclosed. In addition, U.S. Pat. No. 4,672,707 discloses a washing device which requires bending of the bathers body in order to reach remote areas such as the lower legs and feet.

It would be desirable to provide a bathing wiper construction which permits cleaning of parts of the body remote from the hand without the need for bending the bather's body particularly, for bathers who are afflicted with back injury. In addition, it would be desirable to provide a bathing wiper construction which permits thorough cleaning of all parts of the body without the requirement of a cleaning means such as a sponge or cloth having a specific design and shape. Such an apparatus would permit the use of conventionally available cloths or sponges. Furthermore, it would be desirable to provide such an apparatus which permits sanitizing the washing means after use. In addition, such a wiper could be used in environments other than bathing such as for cleaning of the home or automobile. Since the wiper utilizes conventional washing means that can be sanitized, it can be utilized in environments other than bathing such as for use in the home or for an automobile wherein a suitable washing means such as a heavy duty sponge can be substituted for a work cloth.

SUMMARY OF THE INVENTION

The present invention provides a bathing wiper construction which permits washing of all parts of the body without the need for bending the body. In addition, the bathing wiper construction of this invention utilizes conventionally available washing means which can be sanitized subsequent to bathing so that the construction can be utilized by different bathers. The construction, a support plate, a handle secured to the support plate and two strap means for securing a washing element such as a cloth or a sponge to the support plate.

DESCRIPTION OF SPECIFIC EMBODIMENTS

In accordance with this invention, a multipurpose wiper construction is provided which comprises a plate and a handle secured to a central portion of one surface of the plate. Strap means are secured to the two end portions of the plate so that strap means can be utilized to secure a sheet-like washing material such as a towel or a sponge to the plate without interference by the handle. Any means for securing the strap means can be utilized such as a "Velcro" joining system comprising a multiplicity of plastic filaments extending outwardly in diverse directions and having hook-like shapes at the free ends thereof, snaps, fasteners, or the like. The strap means also can comprise string elements which can be tied in an easily removable knot. In any event, the strap means are secured to the plate, preferably at the side surfaces of the plate so that they do not interfere with the placement of the sheet-like washing material on both surfaces of the plate. In a preferred form of this invention, the rod-like handle is attached to the plate at an angle between about 15° and 45° in order to facilitate its use in washing extremities of the body such as the legs or feet or difficult portions of the body such as the back during bathing. In another preferred embodiment, the surface of the plate which is in closest proximity to the bather during bathing and raised portions such as nodules in order to increase the intensity of scrubbing during bathing. In use, the sheet-like washing material is wrapped about the plate and secured thereto by means of the two strap means which are engaged tightly around the sheet-like washing material and which are not interfered by the handle. If the handle were positioned near the end portions of the plate, it would interfere with the positioning of the sheet-like washing material or the functioning of the strap means.

After washing or dusting is completed, the strap means are disengaged and the sheet-like washing material is removed so that it can be washed, e.g., sanitized prior to further use.

Figure 1:
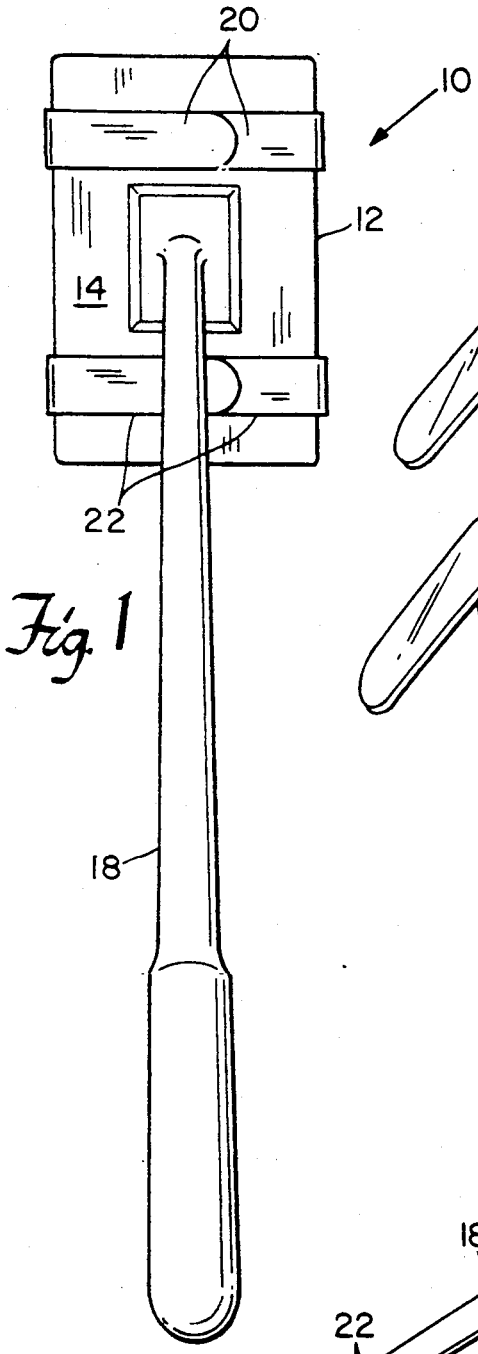
FIG. 1 is a top view of the wiper construction of this invention.
Figure 3:
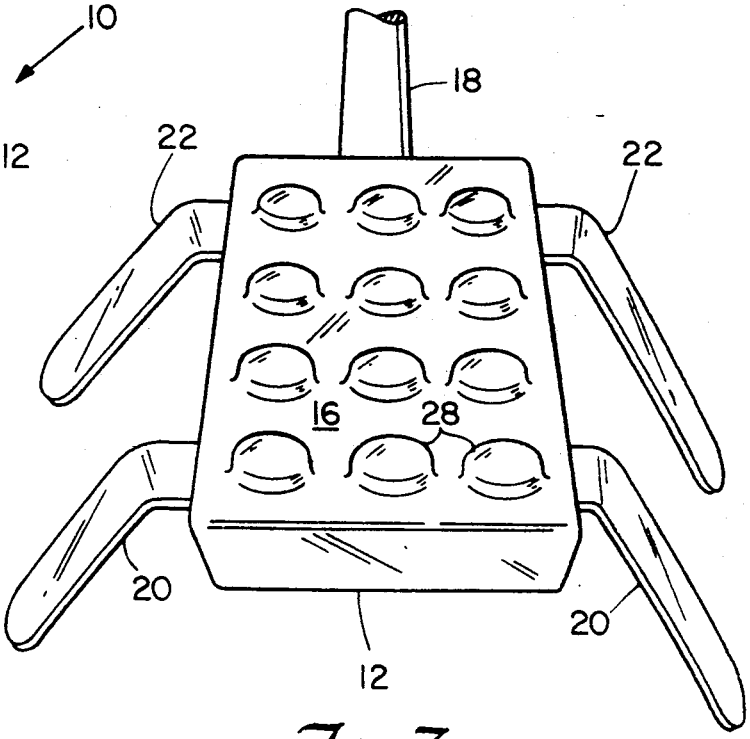
FIG. 3 is an bottom view of one embodiment of the wiper construction of the present invention of this invention.
Figure 2:
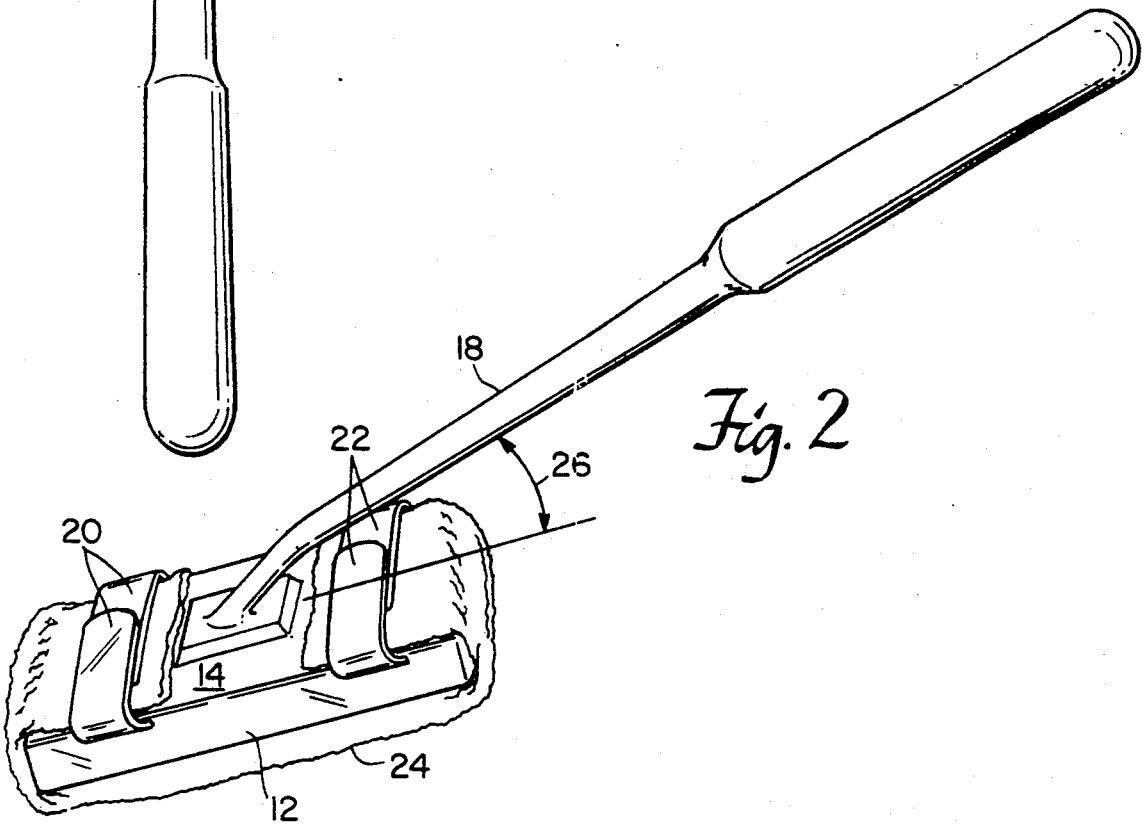
FIG. 2 is an isometric view of the wiper construction of this invention having secured thereto a washing cloth.

Referring to the Figures, the wiper construction 10 includes a plate having a first surface 14 and a second surface 16. A handle 18 is secured to a central portion of plate 12 so as not to interfere with the functioning of the first strap means 20 and the second strap means 22. As shown particularly in FIG. 2, a sheet-like washing material such as a cloth, a sponge or the like 24 is secured to the plate 12 at the first surface 14 thereof by means of strap means 20 and 22. In a preferred form of this invention, the angle 26 between the first surface 14 of plate 12 in the handle is preferably between about 15° and about 45° in order to facilitate bathing at the extremities of the bather's body and in areas which are difficult to reach such as the back. In one form of the present invention, the second surface 16 of plate 12 can include a plurality of raised nodules 28 in order to facilitate scrubbing during bathing. After washing or dusting is completed, the strap means 20 and 22 can be quickly disengaged in order to remove the sheet-like washing material 24 so that a fresh and clean washing material can be substituted while the original washing or dusting material is cleaned. Thus, the wiper construction 10 of this invention can be utilized sequentially by a plurality of bathers or in a variety of environments in a sanitary manner. In addition, the present invention permits the use of conventionally sized cloths or sponges which need not be specially designed in order for use in the present invention. In addition, the present invention does not require bending or twisting in order to to reach all portions of the body during bathing.

I claim:

1. A wiper construction which comprises a plate having a first and a second surface, a handle secured to a central portion of said first surface of said plate, wherein the angle between said handle and said first surface of said plate is between about 15° and 45° degrees, a first strap means secured to a first end portion of said plate, a second strap means secured to a second end portion of said plate, said first and second strap means each comprising two mating strap sections comprising mating surfaces each having a multiplicity of plastic filaments extending outwardly in diverse directions and having hook like shapes at the free ends of said filaments, and said strap means adapted to secure a sheet-like washing material to said first surface of said plate and around said second surface.

2. The wiper construction of claim 1 wherein a second surface of said plate has a raised portion.

3. The wiper construction of claim 1 wherein said plate and handle comprise a one-piece construction.

* * * * *